US007226399B2

(12) United States Patent
Lanoue

(10) Patent No.: US 7,226,399 B2
(45) Date of Patent: Jun. 5, 2007

(54) LOCKOUT MECHANISM FOR EXERCISE EQUIPMENT

(76) Inventor: Jean-Paul Lanoue, 19175 Bluewater Avenue, Tilbury, Ontario (CA) N0P 2L0

( * ) Notice: Subject to any disclaimer, the term of this patent is extended or adjusted under 35 U.S.C. 154(b) by 422 days.

(21) Appl. No.: 10/396,203

(22) Filed: Mar. 25, 2003

(65) Prior Publication Data

US 2004/0192508 A1 Sep. 30, 2004

(51) Int. Cl.
*A63B 21/06* (2006.01)
*A63B 21/062* (2006.01)

(52) U.S. Cl. ..... 482/99; 482/93

(58) Field of Classification Search ..... 482/93, 482/94, 97–104
See application file for complete search history.

(56) References Cited

U.S. PATENT DOCUMENTS 2,788,211 A * 4/1957 Ivanoff ..... 482/4
3,973,251 A 8/1976 Stephas
4,402,503 A 9/1983 Galbierz
4,541,627 A 9/1985 MacLean et al.
5,256,122 A * 10/1993 Deden ..... 482/99
5,356,360 A * 10/1994 Johns ..... 482/99
5,788,610 A 8/1998 Eschenbach
5,813,947 A * 9/1998 Densmore ..... 482/51
5,820,525 A * 10/1998 Riley ..... 482/54
6,077,193 A * 6/2000 Buhler et al. ..... 482/8
6,081,199 A * 6/2000 Hogl ..... 340/5.28
6,394,239 B1 5/2002 Carlson
6,440,042 B2 8/2002 Eschenbach
6,656,091 B1 12/2003 Abelbeck et al.
6,814,708 B1 * 11/2004 Jennings ..... 601/24

FOREIGN PATENT DOCUMENTS

GB 2214095 A 8/1989

* cited by examiner

*Primary Examiner*—Stephen R. Crow
(74) *Attorney, Agent, or Firm*—Carlson, Gaskey & Olds, PC

(57) ABSTRACT

A lockout mechanism allows for controlled use of exercise equipment. Use is allowed on a time-controlled basis. A predetermined period of time is allocated based on an amount of money paid. The preferred embodiments include a coin-operated, time-controlled, lockout mechanism incorporated onto various types of exercise equipment to prohibit use. The first category including those types of exercise equipment which utilize flywheels, including but not limited to: elliptical trainers, stationary bicycles, stair steppers and cross-country ski machines. This first embodiment employs a friction device to prohibit use. The second category including those types of exercise equipment which utilize adjustable resistance in the form of a weight stack, including but not limited to: universal gyms and nautilus equipment. This second embodiment employs a spring loaded latch mechanism to prohibit use. A third category includes those types of exercise equipment which require electricity to operate. This third embodiment employs a timer circuit to interrupt power to prohibit use.

6 Claims, 2 Drawing Sheets

LOCKOUT MECHANISM FOR EXERCISE EQUIPMENT

BACKGROUND OF THE INVENTION

The present invention relates to a lockout mechanism, and more particularly to a coin-operated, time-controlled lockout mechanism for exercise equipment.

Exercise equipment, for public use, is primarily found in gyms, health clubs and other membership exclusive exercise facilities. These exercise facilities, however, charge monthly membership fees for access. As exercise equipment continues to become more advanced it also becomes more expensive. The exercise facilities then transfer the rising equipment costs to their users in the form of increased monthly membership fees. These membership fees are assessed without consideration of the access desired by the member. Access can include use of various types of exercise equipment similar to those addressed in this invention but it can also encompass access to free-weights and an array of group exercise classes. Not everyone that exercises desires to use free-weights and not everyone that exercises wants to participate in group exercise. They simply want access to utilize the particular exercise equipment, addressed by this invention, without being required to pay the same monthly fee of those who desire the full service access.

The average user may only want to utilize a particular piece of exercise equipment at the exercise facility once or twice a week and may not take advantage of the facility simply because the membership fees are excessive. This average user may, however, choose to patronize the exercise facility if they could pay only for the actual usage of a piece of exercise equipment for a predetermined period of time. By providing a lockout mechanism which allows the user to pay for the actual usage, as opposed to committing to a monthly membership fee, access to such equipment can be greatly increased.

Accordingly, it is desirable to provide a more cost-effective alternative to expensive gym memberships.

SUMMARY OF THE INVENTION

The lockout mechanism according to the present invention provides for controlled use of exercise equipment. Use is allowed on a time-controlled basis. A predetermined period of time is allocated based on an amount of money paid. Upon expiration of the purchased period of time, the lockout mechanism is engaged to prohibit further use.

The preferred embodiments include a coin-operated, time-controlled lockout mechanism incorporated onto various types of exercise equipment. Three basic categories of exercise equipment with which the present invention is integrated are given as examples: 1) those which utilize flywheels, 2) those which utilize resistance in the form of a weight stack and 3) those which require electricity to operate.

The first category of exercise equipment utilizes a flywheel which is driven by user exercise and includes but is not limited to: elliptical trainers, stationary bicycles, stair-steppers and cross-country ski machines. This first embodiment employs a coin-operated, time-controlled locking mechanism which includes a linearly actuated piston assembly connected to a brake shoe assembly. The user inserts coins into a coin-accepter, each coin representing a predetermined period of time. Upon coin insertion, the locking mechanism disengages the brake shoe assembly from the flywheel to allow use of the exercise equipment. Upon expiration of the purchased period of time, the locking mechanism re-engages the brake shoe assembly to the flywheel exerting a friction force sufficient to cease rotation thus prohibiting further use.

The second category of exercise equipment utilizes adjustable resistance in the form of a weight stack which is actuated by user exercise and includes but is not limited to: universal gyms and nautilus equipment. This second embodiment employs a coin-operated, time-controlled locking mechanism which includes a linearly actuated piston assembly connected to a spring loaded latch. The user inserts coins into a coin-accepter, each coin representing a predetermined period of time. Upon coin insertion, the locking mechanism disengages the spring loaded latch from a locking plate attached to the top of the weight stack to allow use of the exercise equipment. Upon expiration of the purchased period of time, the locking mechanism re-engages the spring loaded latch to the locking plate providing a positive stop thus prohibiting further use.

The third category of exercise equipment requires electricity to operate and includes but is not limited to treadmills, stationary bicycles, elliptical trainers and stair-steppers. This third embodiment employs a coin-operated timer circuit. The user inserts coins into a coin-accepter, each coin representing a predetermined period of time. Upon coin insertion, the timer-circuit is closed, providing a flow of electricity to the exercise equipment allowing user exercise. Upon expiration of the purchased period of time, the timer-circuit opens, interrupting the flow of electricity to the exercise equipment thus prohibiting further use.

BRIEF DESCRIPTION OF THE DRAWINGS

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

The present invention provides a mechanism for selectively prohibiting the use of exercise equipment, the use being restricted based on expiration of a predetermined period of time which is purchased by the user. Although the present invention can be used in many different types of exercise equipment, three examples of different categories of exercise equipment are described here.

Figure 1:
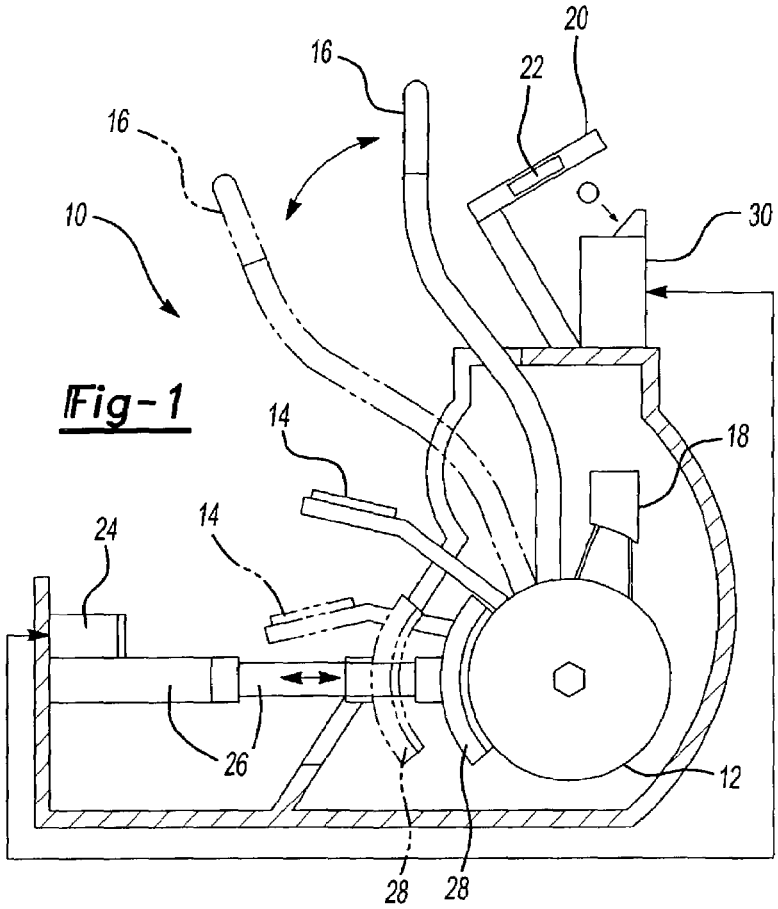
FIG. 1 illustrates a first embodiment of the present invention as adapted to an elliptical trainer.

FIG. 1 illustrates exercise equipment with the lockout mechanism of the present invention which incorporates friction to restrict use. The elliptical trainer 10 includes a flywheel 12 that is driven by user exercise, user exercise being defined as requiring an elevated level of physical exertion. This user exercise generates a force which is transmitted to the flywheel 12 through the elliptical rotation of a set of pedal assemblies 14. Transmission of user exercise causes the flywheel 12 to rotate, facilitating user exercise by providing an initial resistance and a continued momentum required to maintain a level of exercise.

A set of handles 16 can be utilized to increase the level of user exercise. The set of handles 16 are also mounted to the flywheel 12 in a manner as to benefit from its previously mentioned resistive characteristics.

In addition, a resistance mechanism 18, which may be in the form of but is not limited to a pulley and belt system, an electromagnetic system or friction device, is incorporated to selectively provide additional adjustable resistance which would increase the level of user exercise allowing for the achievement of a higher level of user fitness. The level of resistance as well as the duration of exercise are measured and tracked on an integral computer 20, which includes a timer 22.

A lockout mechanism includes an actuator 24, a piston assembly 26 and a brake shoe assembly 28. The lockout mechanism is mounted such that upon actuation of the actuator 24 the brake shoe assembly 28 will engage the flywheel 12 with sufficient force to prohibit use of the equipment A coin accepter 30 is incorporated and connected to the computer 20, the timer 22 and the actuator 24 of the lockout mechanism.

In operation, the lockout mechanism is initially in the locked position, with the brake shoe assembly 28 engaged with the flywheel 12 such that use is prohibited. A user wishing to exercise on the elliptical trainer 10 deposits money into the coin accepter 30 in exchange for usage for a predetermined period of time. Each coin represents a predetermined block of time. Upon deposit of coins into the coin-accepter 30, the appropriate number of predetermined blocks of time are added to the timer 22. The computer 20 then disengages the locking mechanism by causing actuator 24 to release the brake shoe assembly 28 from flywheel 12. The exercise equipment will then be available for use for the period of time paid for. Upon expiration of the purchased period of time the lockout mechanism will be activated by computer 20, specifically the actuator 24 will actuate the piston assembly 26 which engages the brake shoe assembly 28 to the flywheel 12 thereby prohibiting use.

Other types of exercise equipment that utilize flywheels, such as stationary bicycles, stair-steppers and cross-country ski machines could utilize the lockout mechanism described above in a similar manner.

Figure 2:
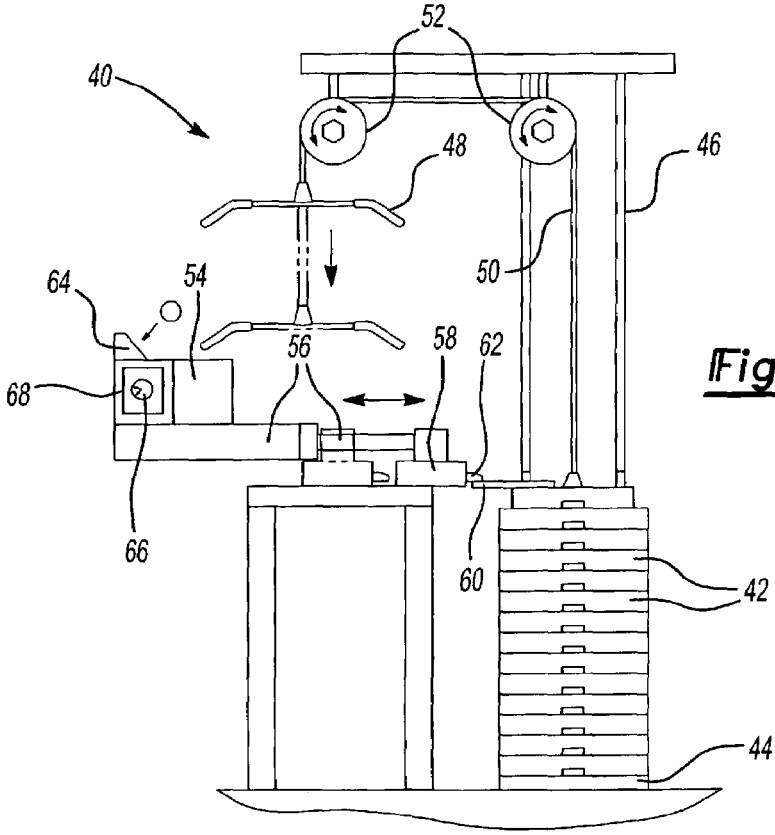
FIG. 2 illustrates a second embodiment of the present invention as adapted to a universal gym.

FIG. 2 illustrates exercise equipment with the lockout mechanism of the present invention which incorporates a spring loaded latch to restrict use. The universal gym 40 incorporates an adjustable weight stack 42 to provide variable resistance for user exercise. The adjustable weight stack 42 is made up of a plurality of individual weight plates 44 which are positioned on locating devices, such as rods 46 to allow for orderly stacking. The rods 46 also serve to guide the weight plates 44 throughout the exercise and back into a rest position following the completion of the exercise. The user selects a specific number of weight plates 44 to be actuated based on the relative level of physical exertion desired. The user then repeatedly actuates the pre-selected weight stack 42 by means of a handle 48 connected to the weight stack 42 by a cable 50 which is attached to the weight stack 42 by a pulley system 52.

A locking plate 60 is mounted to the top most weight plate of the weight stack 42.

A lockout mechanism 42, which includes an actuator 54, a piston assembly 56 and a spring-loaded latch 58, is mounted adjacent to the weight stack 42. The lockout mechanism is located such that, upon actuation, the spring-loaded latch 58 engages the locking plate 60 prohibiting further use. The spring-loaded latch 58 includes a beveled edge 62 which allows the weight stack 42 to return to its rest position when the latch 58 is in the locked position.

A coin accepter 64 is incorporated in conjunction with a timer 66 and computer 68 to provide a control for the lockout mechanism. In operation, the lockout mechanism is initially in the locked position where the latch 58 is extended to engage locking plate 60 to prevent lifting of the weight stack 42. The user deposits money into coin accepter 64 in exchange for usage for a predetermined period of time. Each coin represents a predetermined block of time. Upon deposit of coins into the coin-accepter 64 the appropriate number of predetermined blocks of time will be added to the timer 66. The computer 68 will cause actuator 54 to retract latch 58 to where latch 58 does not engage the locking plate 60. The exercise equipment will then be available for use for the period of time paid for. Upon expiration of the purchased period of time the lockout mechanism will be activated by computer 68, specifically the actuator 54 will actuate the piston assembly 56 which will extend the spring loaded latch 58 to a locked position. If the weight stack 42 is in the lifted position upon the expiration of the predetermined period of time, the locking plate 60 will engage the beveled edge 62 of the spring-loaded latch 58, thereby causing latch 58 to temporarily retract so that the locking plate 60 and weight stack 42 can fully return to the rest position. The spring-loaded latch will then spring return back to the extended, locked position where it engages the locking plate 60, thereby prohibiting further actuation of the weight stack 42.

Other exercise equipment that uses weights or a weight stack could also use the lockout mechanism described above in a similar manner.

Figure 3:
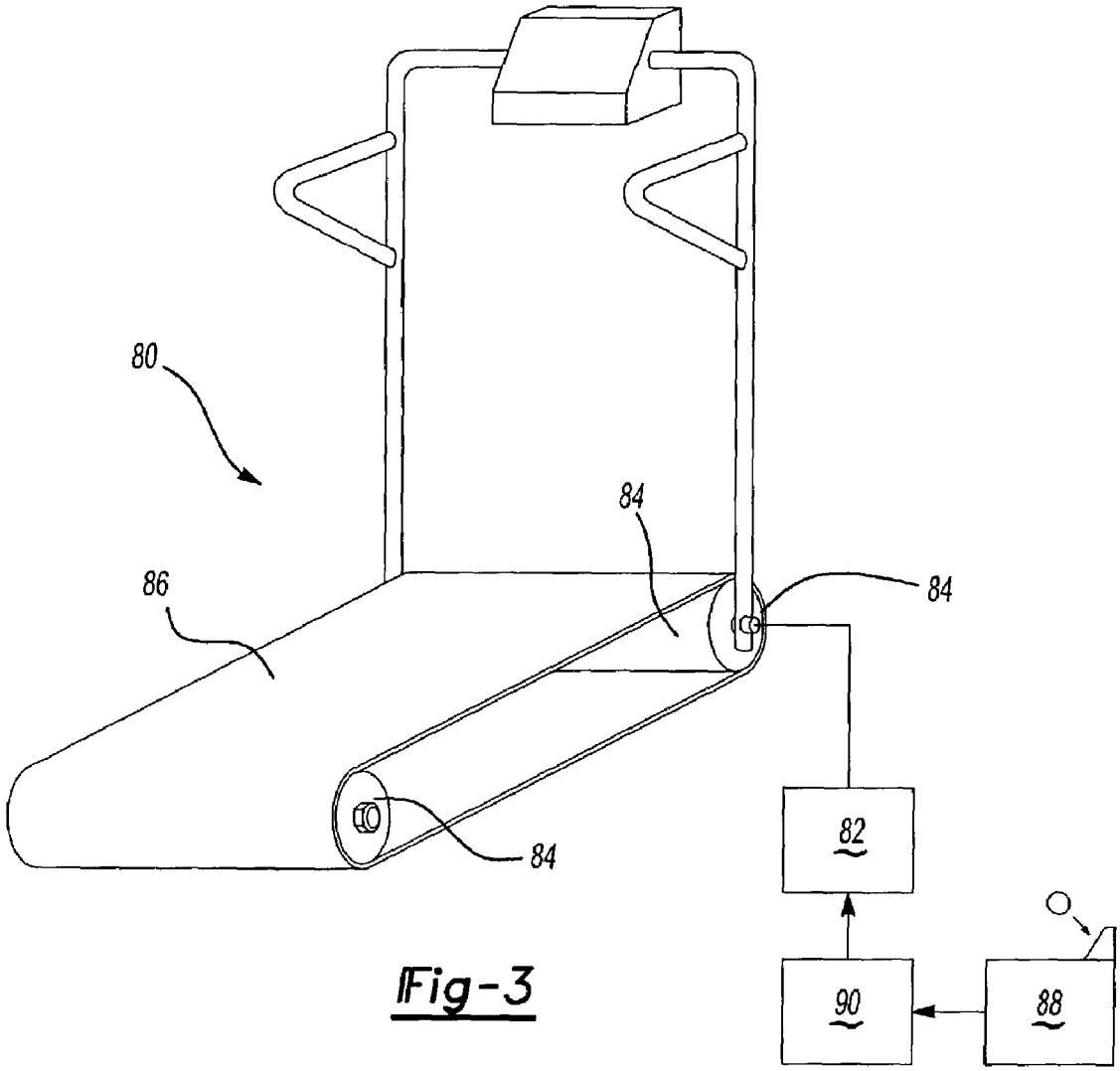
FIG. 3 illustrates a third embodiment of the present invention as adapted to a treadmill.

FIG. 3 illustrates exercise equipment with the lockout mechanism of the present invention which incorporates a timer circuit that interrupts power to prohibit use. The treadmill 80 incorporates an electric motor 82 which drives a roller system. The roller system includes two rollers 84 on which a belt 86 rotates and provides a surface for a user to exercise upon. The treadmill, electric motor 82 in particular, requires electricity to operate.

A coin accepter 88 is incorporated in conjunction with a timer circuit 90 to provide a control and lockout mechanism to restrict use. The timer circuit 90 may be implemented using a computer or any timer circuit and controls the supply of power to the electric motor 82.

In operation, the lockout mechanism is initially in the locked state, in which power to the electric motor 82 is interrupted. The user deposits money in exchange for usage for a predetermined period of time. Each coin represents a predetermined block of time. Upon deposit of coins into the coin-accepter 88 the appropriate number of predetermined blocks of time will be added to the timer circuit 90. The timer circuit 90 will then provide or permit power to be provided to the electric motor 82. The exercise equipment will then be available for use for the period of time paid for. Upon expiration of the purchased period of time the timer circuit 90 will interrupt the electrical power to the treadmill discontinuing use.

Other exercise equipment that requires electricity to operate, such as stationary bicycles, elliptical trainers and stair-steppers could also use the lockout mechanism described above.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. Exercise equipment comprising:

an adjustable weight stack, including a plurality of weight plates, wherein the adjustable weight stack is actuated during exercise to provide resistance, a locking plate installed onto the adjustable weight stack;

a lockout mechanism for selectively prohibiting actuation of the adjustable weight stack, the lockout mechanism including an actuating assembly, the actuating assembly having an engaged position and a retracted position, the engaged position in contact with the locking plate to prohibit movement of the weight stack, the retracted position such that movements of the weight stack is allowed; and a timer connected to the lockout mechanism which engages the lockout mechanism upon expiration of the predetermined period of time.

2. Exercise equipment of claim 1 further comprising cables for actuating the weight stack; and a locating device to allow orderly stacking of the weight plates.

3. Exercise equipment of claim 1, wherein the timer is coin activated; and the predetermined period of time is based on an amount of money deposited.

4. Exercise equipment comprising:

an adjustable weight stack, including a plurality of weight plates;

the weight stack being actuated during exercise to provide resistance;

a locking mechanism for selectively prohibiting use, wherein the lockout mechanism further includes:

an actuating assembly;

a locking plate installed onto the adjustable weight stack;

the actuating assembly having an engaged position and a retracted position, wherein the actuating assembly includes a piston assembly;

the engaged position in contact with the locking plate to prohibit movement of the weight stack; and the retracted position such that the movements of the weight stack is allowed.

5. Exercise equipment of claim 4, wherein the piston assembly is linearly actuated.

6. Exercise equipment of claim 5, wherein the linearly actuated piston assembly further defines a first end and a second end; and a spring loaded latch attached to the first end of the linearly actuated piston assembly, the spring loaded latch having a beveled edge as to allow return of the weight stack to a rest position upon expiration of the predetermined period of time.

* * * * *